United States Patent [19]

Dodge et al.

[11] 4,134,232

[45] Jan. 16, 1979

[54] ANIMAL DOOR ASSEMBLY

[75] Inventors: Leonard P. Dodge, Romford; Wendy E. Morley, Brentwood, both of England

[73] Assignee: Petdoors Limited, Romford, England

[21] Appl. No.: 832,621

[22] Filed: Sep. 12, 1977

[51] Int. Cl.[2] ..... E05F 1/10

[52] U.S. Cl. ..... 49/386; 16/72

[58] Field of Search ..... 49/386, 388, 333, 9, 49/34; 16/71, 72, 78

[56] References Cited

U.S. PATENT DOCUMENTS

| | | | |
|---|---|---|---|
| 1,650,276 | 11/1927 | Hull et al. | 49/386 |
| 2,839,791 | 6/1958 | Lee | 49/386 X |
| 3,142,095 | 7/1964 | Sawyer | 49/386 X |
| 3,184,803 | 5/1965 | Peel | 49/388 |

*Primary Examiner*—Kenneth Downey
*Attorney, Agent, or Firm*—Emory L. Groff, Jr.

[57] ABSTRACT

An animal door assembly has a frame and a door mounted in the frame by a hinge which has a hinge axis which permits opening of the door in both directions to each side of the doorway. A spring is coupled with an edge of the door and acts between a position on the frame disposed inwardly of the door opening away from the hinge axis and a position fixed in relation to the door and offset radially from the hinge axis. The position is so arranged as to adapt the assembly to induce resilient deformation of the spring during opening of the door and to induce a reduction in the rate of deformation with movement of the door as it approaches the open position. The spring serves to urge the door towards the closed position when opened in either direction.

17 Claims, 6 Drawing Figures

ANIMAL DOOR ASSEMBLY

BACKGROUND OF THE INVENTION

This invention relates to animal door assemblies of the type which enable opening by the animal and automatic closure when the animal has passed through.

Animal doors or flaps for insertion into existing doors are known to us which have a horizontal hinge and which open in one direction only and which normally close under the action of gravity. The single direction opening capability is a disadvantage in many applications and these known constructions do not provide effective and positive closure of the door.

SUMMARY OF THE INVENTION

It is an object of this invention to provide an improved animal door in which one or more of the before mentioned disadvantages of known arrangements is obviated or at least substantially reduced.

According to the invention there is provided an animal door assembly comprising a frame, a door mounted in the frame and secured to the frame by hinge means permitting opening of the door in both directions to each side of the doorway and resilient means coupled with an edge of the door and acting between a position on the frame disposed inwardly of the door opening away from the hinge axis and a position fixed in relation to the door and offset radially from the hinge axis which position is so arranged as to adapt the assembly to induce resilient deformation of said resilient means during opening movement of the door and to induce a reduction in the rate of deformation with movement of the door as it approaches the open position the resilient means being effective to urge the door towards the closed position when opened in either direction.

The frame may be arranged to extend round all edges of the door.

In a preferred form the frame has a flange extending substantially perpendicularly of the door edge when closed and the resilient means is mounted wholly within the depth of the flange.

BRIEF DESCRIPTION OF THE DRAWINGS

In order that the invention and its various other features may be understood more easily an embodiment thereof will now be described, by way of example only, with reference to the drawings in which.

DESCRIPTION OF PREFERRED EMBODIMENTS

Figure 3:
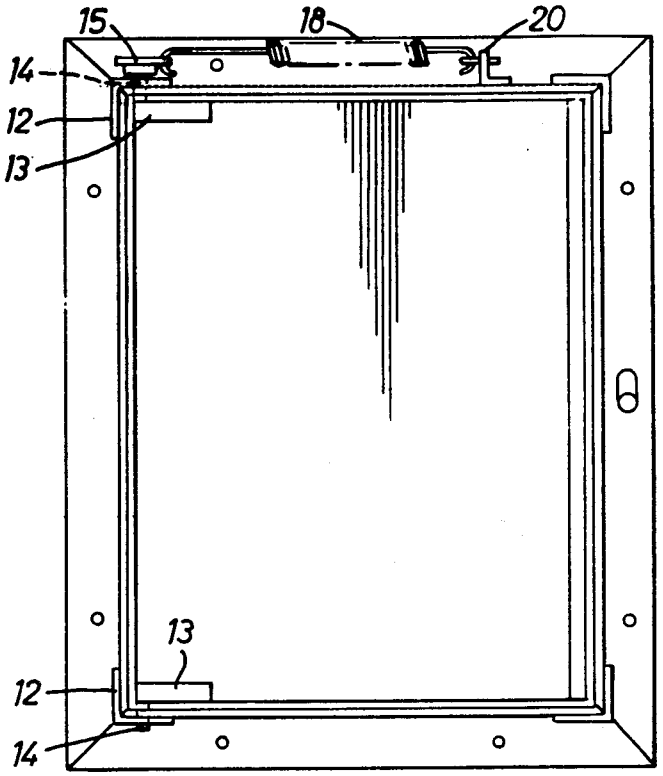
FIG. 3 is a rear view of the assembly of FIG. 1.
Figure 2:
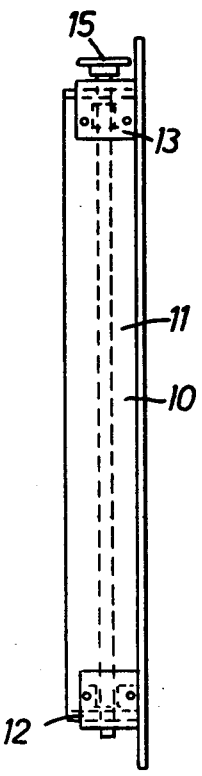
FIG. 2 is a side view of the assembly of FIG. 1.
Figure 5:
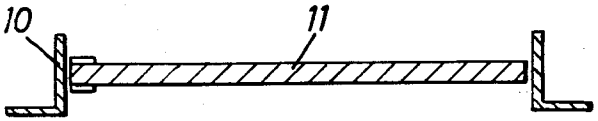
FIG. 5 is a cross sectional view on the line A—A of FIG. 1.

The animal door assembly shown in the drawings comprises a rectangular frame 10 and a door 11. The frame 10 is formed of four lengths of "L" section extruded aluminium secured together at adjacent ends by aluminium brackets 12. The door 11 is formed of a transparent plastics material e.g. perspex and is provided with "U" shaped metal edge connectors 13 at upper and lower corners which are secured to the door by a resilient clamping action. The edge connectors are each provided with a pin 14 which serve as hinge pivots for the door. The pins 14 project vertically as shown in FIG. 3 into engagement with respective holes in the frame 10 and brackets 12 and form trunnions which enable the door to be opened in both directions i.e., inwardly and outwardly.

The upper pin 14 as shown in the drawing of FIG. 3 is arranged to project beyond the bracket 12 and serves for receiving a wheel 15 which is secured thereto by a screw 16 (see FIG. 6) to enable the wheel to turn with opening and closing of the door. The wheel is provided near its periphery with two through holes 17 mutually spaced at an angle of 150° and serves as a securing member for resilient means formed by two coil springs 18 and 19 each having a hook end engaging a respective one of the holes and an opposite hook end coupled with a bracket 20 secured to the top length of the frame in a manner as can be seen in detail in FIG. 6. In this way the resilient means is coupled to the wheel 15 radially outwardly of the hinging axis and is indirectly coupled to the door via the pin 14.

Figure 6:
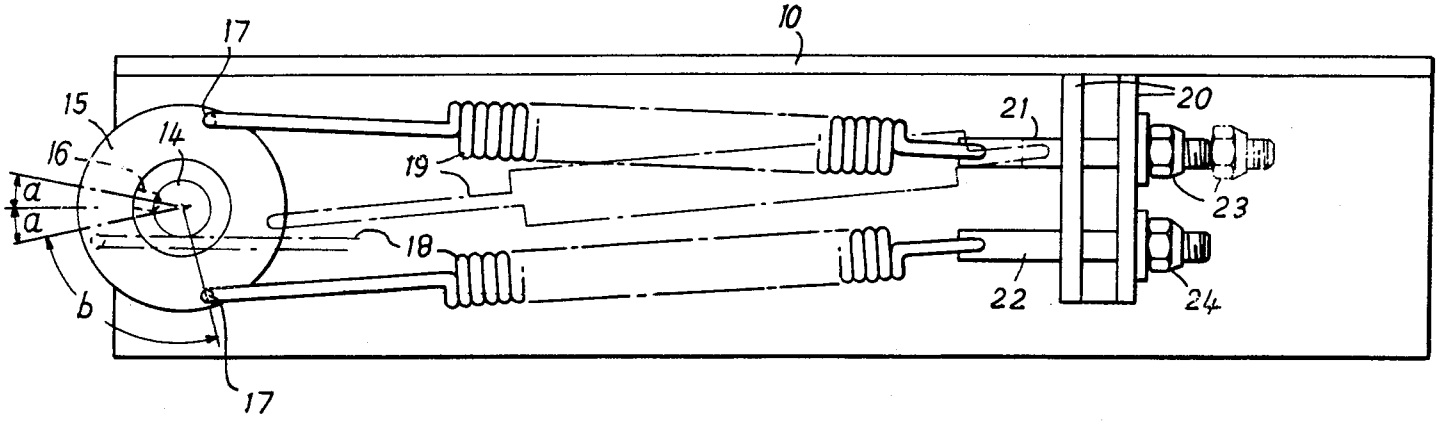
FIG. 6 is an over plan view to an enlarged scale illustrating the operation of the closing mechanism.

The drawing of FIG. 6 shows that the bracket 20 is a cross head and that the springs 18 and 19 are each coupled therewith via respective spring rods 21 and 22 which are slidably located therein and secured against spring tension by nuts 23 and 24 respectively. The drawing also shows the effect on the springs 18, 19 as the door is opened in one direction in this case anticlockwise as viewed from above. The springs are shown in solid lines to represent the closed position of the door and in dotted lines to represent the open position of the door. As can be seen the spring 18 is tensioned and the spring rod 21 is pushed to the right through the cross head by opening in this direction. The springs are effective to urge the door to the closed position upon release of the door and the springs provide an initially slow or delayed closing action which avoids trapping of the animal's tail, followed by a positive snap closure of the door under a force dependant on the strength of the springs the force exerted by which is arranged to be adjustable by virtue of the nuts 23 and 24. Clearly, when the door is opened in the other direction i.e., anticlockwise as viewed from above the spring 19 will be tensioned and the rod 22 will be pushed to the right. No compression of the springs takes place at all.

The door is permitted to open through an angle "b" in either direction and this moves the hole 17 to an angle "a" before the plane of the door frame opening. This prevents the spring end overshooting the plane of the door frame and avoids retention of the door in the open position. The angle "b" in this embodiment is 93° and the angle "a" is 12°.

Figure 1:
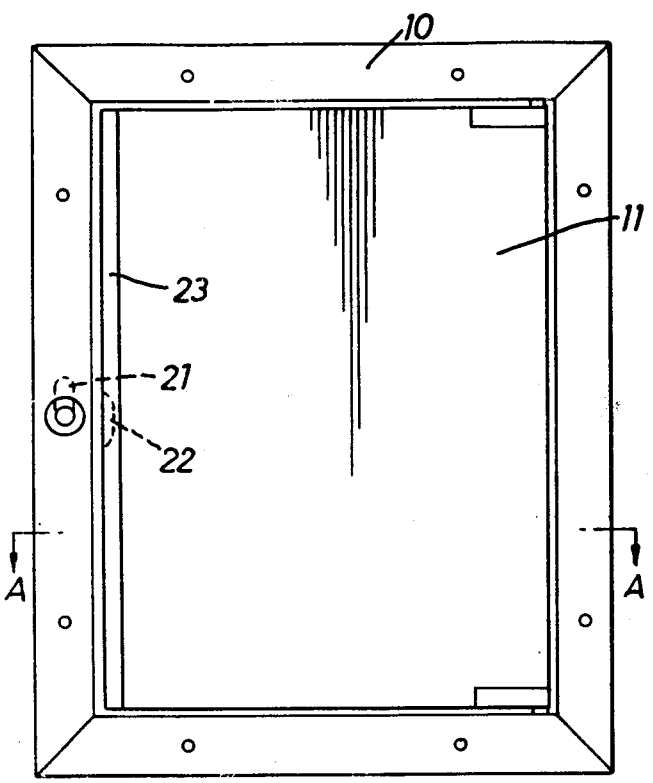
FIG. 1 is a front view of an animal door assembly arranged in accordance with the invention.
Figure 4:
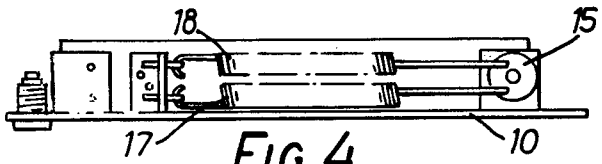
FIG. 4 is an over plan view of the assembly of FIG. 1.

The embodiment of this example is provided with a locking mechanism enabling securement of the door in the closed position or preventing opening in a selected one of the two directions. The locking mechanism may be key operated and comprises a finger 21 movable into engagement with a slot 22 in an edge strip 23 attached to the edge of the door as shown in FIG. 1. The finger 21 may be operated to project into the frame aperture when the door is opened to one side or the other side and this will block subsequent opening of the door in the other direction. This enables selective blocking of the door against opening in one direction whilst still permitting opening in the other direction.

It is to be understood that whilst the dual spring actuation of the closure is preferred it would also be possible to effect automatic closure in both directions by a single spring or by resilient means other than a spring.

The animal door assembly provides a self contained door unit suitable for mounting within an existing door, wall or barrier to allow free access through for animals. The door as described swings open in a horizontal direction but could be mounted so as to swing open in a vertical direction.

The door panel is transparent, is virtually silent and non frightening to animals in operation. In view of the effective spring closure of the door in either direction an effective draft proofing can be effected for example by providing resilient draft excluding strips around the edge of the door or the frame. The spring mechanism described is particularly neat in that it is accommodated wholly within the "L" section of the frame and within the thickness of a suitable door or structure to which the frame is fixed.

It will be understood that the above description of the present invention is susceptible to various modification changes and adaptations.

What is claimed is:

1. An animal door assembly comprising a frame, a door mounted in the frame hinge means secured to the frame and to the door which hinge means has a hinge axis arranged to permit opening of the door in both directions to each side of the doorway and resilient means coupled with an edge of the door and acting between a position on the frame disposed inwardly of the door opening away from the hinge axis and a position fixed in relation to the door and offset radially from the hinge axis which position is so arranged as to adapt the assembly to induce resilient deformation of said resilient means during opening movement of the door and to induce a reduction in the rate of deformation with movement of the door as it approaches the open position the resilient means being effective to urge the door towards the closed position when opened in either direction.

2. An animal door assembly in accordance with claim 1 wherein the resilient elements are arranged to act on the door at respective mutually spaced positions disposed radially of the hinge axis.

3. An animal door assembly in accordance with claim 2 wherein the resilient elements are arranged to act on the door at respective positions mutually displaced by 150° about the hinge axis.

4. An animal door assembly in accordance with claim 2, so adapted and arranged that the resilient means acts on the door at positions disposed to opposite sides of a plane which includes the hinge axis and which extends parallel to the door frame the positions being arranged such that axes which extend radially of the hinge axes through each said position define with the plane to the side of the hinge axis opposite the door opening an obtuse angle when the door is in the closed position and an acute angle when the door is in the open position.

5. An animal door assembly in accordance with claim 4, wherein said obtuse angle is 105° and said acute angle is 12°.

6. An animal door assembly in accordance with claim 1, wherein the frame extends round all edges of the door.

7. An animal door assembly as claimed in claim 1, wherein the frame has a flange extending substantially perpendicularly of the door edge when closed and the resilient means is mounted wholly within the depth of the flange.

8. An animal door assembly in accordance with claim 1, wherein the door has an edge which extends at right angles to the hinge axis and the resilient means is coupled therewith.

9. An animal door assembly in accordance with claim 8, wherein the door is provided with a securing member for the resilient means which securing member is adapted to engage the resilient means radially outwardly of the hinge axis of the door to indirectly couple the resilient means to the door.

10. An animal door assembly in accordance with claim 9, wherein trunnions are provided which extend from opposite edges of the door, holes are provided oppositely disposed in the frame, and the trunnions are engaged in the holes to form the hinge means.

11. An animal door assembly in accordance with claim 10 wherein the trunnions are mounted fixedly against rotation on the edge of the door and said securing member is mounted on one of the trunnions and is movable therewith.

12. An animal door assembly in accordance with claim 9 wherein the securing member is a wheel.

13. An animal door assembly as claimed in accordance with claim 1 wherein the resilient means comprises two resilient elements each effective to urge the door towards the closed position from a respective one of said open directions.

14. An animal door assembly in accordance with claim 1 wherein the resilient elements are coil springs.

15. An animal door assembly in accordance with claim 1 including a locking mechanism co-operating between the door and the frame and operable to secure the door in the closed position.

16. An animal door assembly in accordance with claim 15 wherein the locking mechanism is adapted to enable retention of the door against opening in either one of the directions selectively whilst permitting opening in the other direction.

17. A door wall or structure provided with an animal door assembly, in accordance with claim 1, and mounted in an aperture therein such that the opening action of the animal door is in a horizontal plane.

* * * * *